United States Patent [19]

Fukami et al.

[11] Patent Number: 4,546,733

[45] Date of Patent: Oct. 15, 1985

[54] RESONATOR FOR INTERNAL COMBUSTION ENGINES

[75] Inventors: Yasuhiko Fukami, Nishikasugai; Toshiichi Sawada, Kariya; Shuzo Kinkori, Okazaki, all of Japan

[73] Assignee: Nippondenso Co., Ltd., Kariya, Japan

[21] Appl. No.: 592,006

[22] Filed: Mar. 21, 1984

[30] Foreign Application Priority Data

Mar. 22, 1983 [JP] Japan ..... 58-47751
May 20, 1983 [JP] Japan ..... 58-89719

[51] Int. Cl.[4] ..... F02M 35/00

[52] U.S. Cl. ..... 123/52 MB; 60/312; 123/399; 181/182; 181/229

[58] Field of Search ..... 123/57 M, 52 MV, 190 D, 123/399, 52 MB; 60/312; 181/182, 204, 212, 214, 229

[56] References Cited

U.S. PATENT DOCUMENTS 1,114,511 10/1914 Paulsen ..... 123/190 D
1,289,425 12/1918 Fekete ..... 123/52 M
3,254,484 6/1966 Kopper ..... 60/312
4,359,028 11/1982 Fiala ..... 123/399
4,422,415 12/1983 Matsuo et al. ..... 123/52 M

FOREIGN PATENT DOCUMENTS 1009429 5/1957 Fed. Rep. of Germany ... 123/52 M
1601350 11/1970 Fed. Rep. of Germany ..... 60/312
1205076 1/1960 France ..... 123/52 M
2378183 8/1978 France ..... 123/52 M
0051909 4/1980 Japan ..... 123/52 MB
0087821 7/1980 Japan ..... 123/52 MB

*Primary Examiner*—Craig R. Feinberg
*Attorney, Agent, or Firm*—Cushman, Darby & Cushman

[57] ABSTRACT

A resonator for internal combustion engines having intake and exhaust pipes connected with a cylinder of said internal combustion engines comprising resonator means for absorbing resonant noises generated in said engines, a plurality of tubular connecting members disposed between said resonator means and one of said pipes for forming a continuous passage from said one pipe to said resonator means, and switch means connected with said tubular connecting means for changing said tubular connecting members in accordance with operational conditions of said engines to absorb said noises from said engines.

13 Claims, 25 Drawing Figures

FIG. 1
(PRIOR ART)
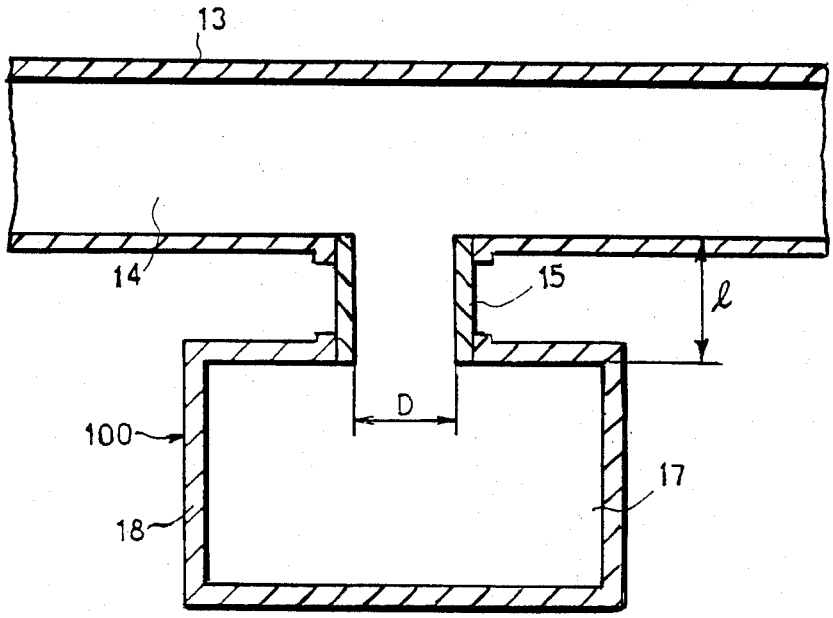
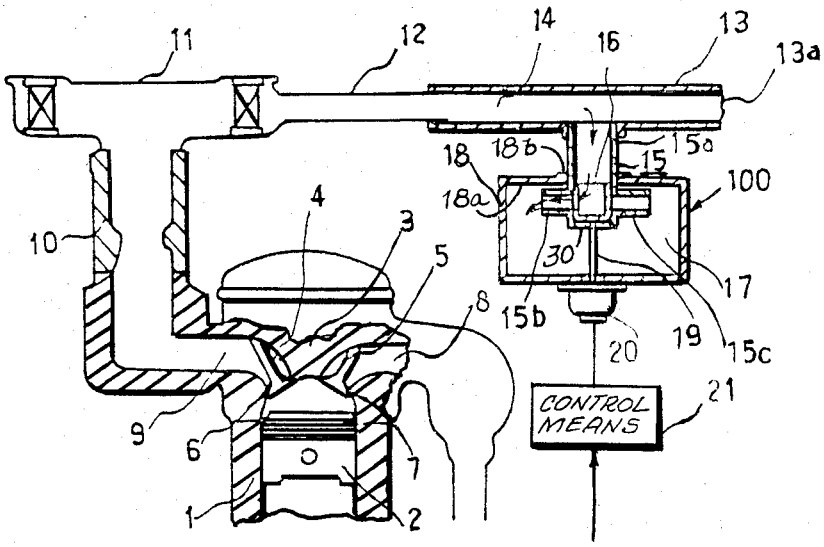
FIG. 2

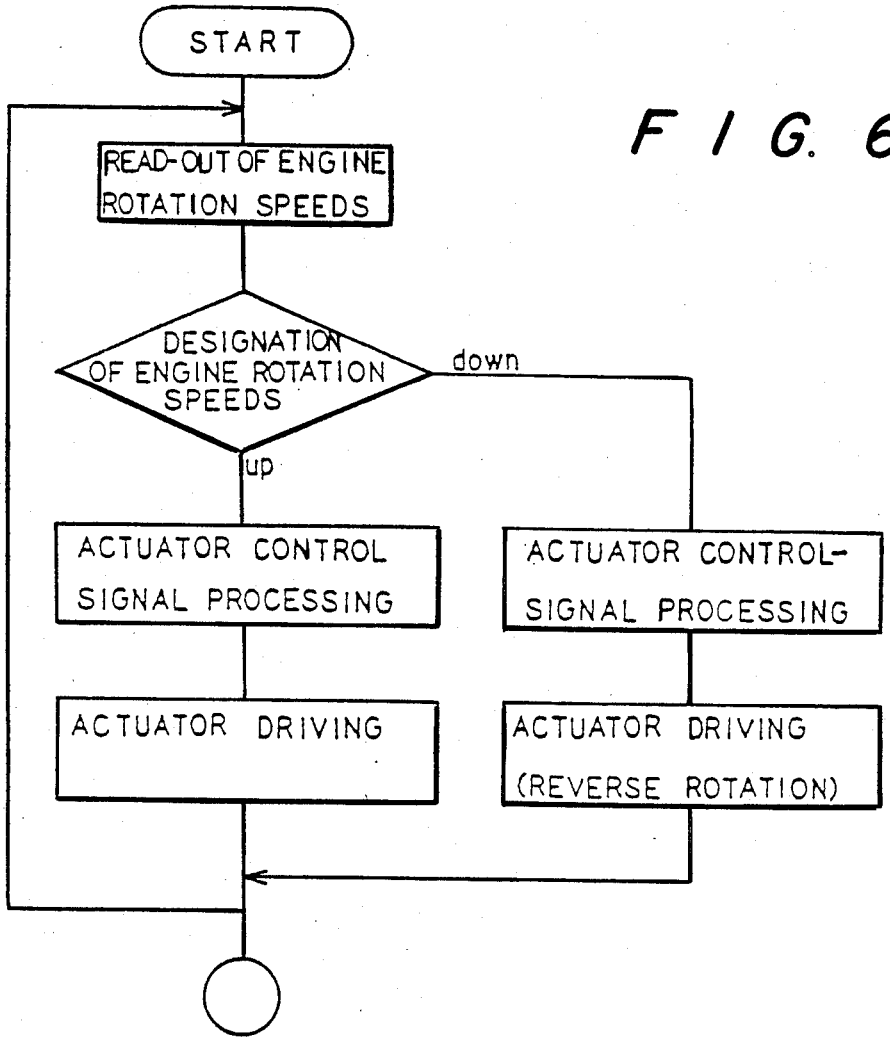
FIG. 6
FIG. 7
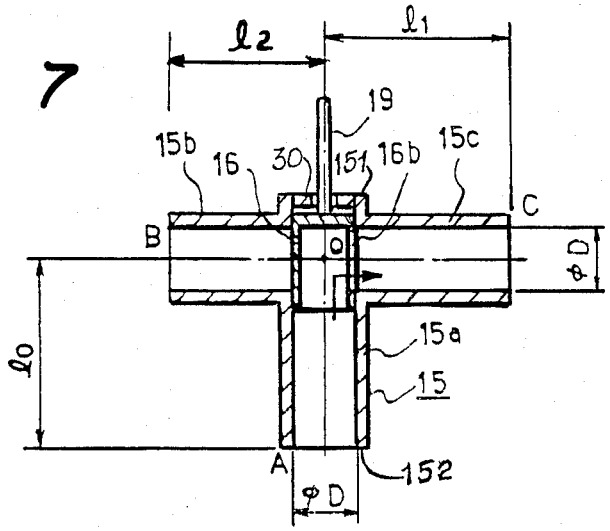

FIG. 8
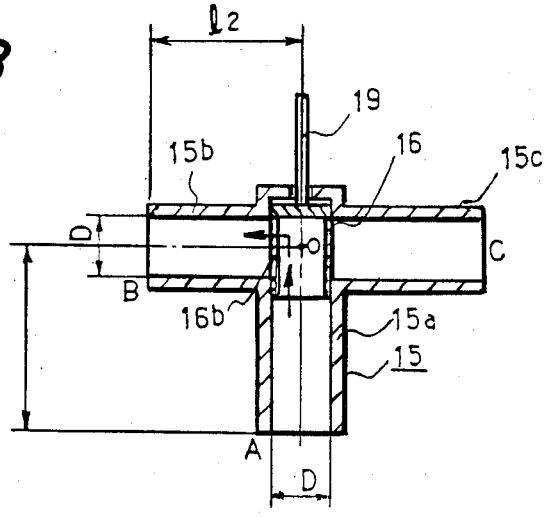
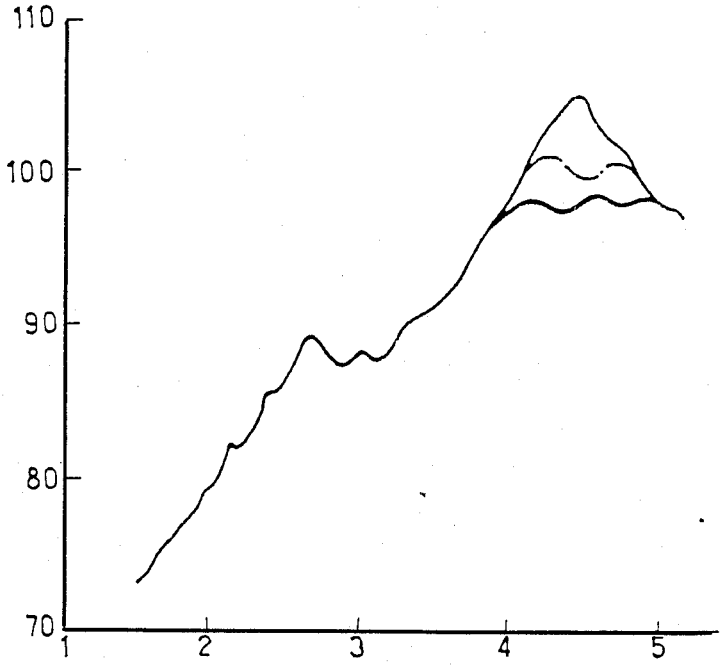
FIG. 9

FIG. 10
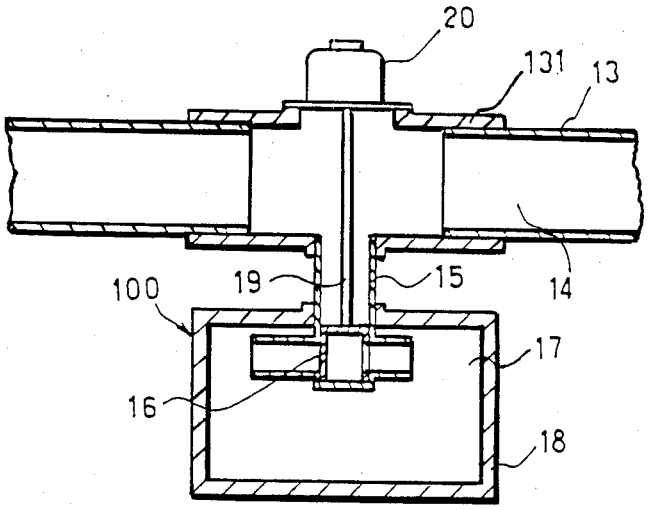
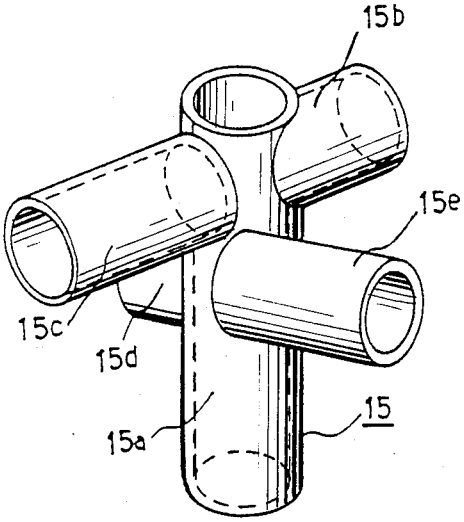
FIG. 11
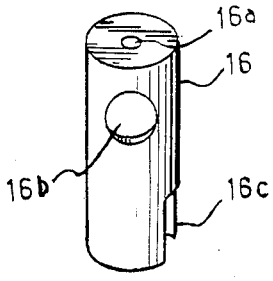
FIG. 12

FIG. 24
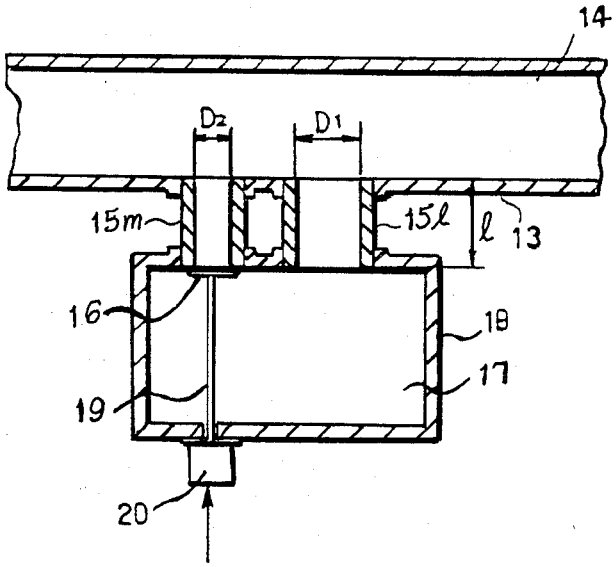
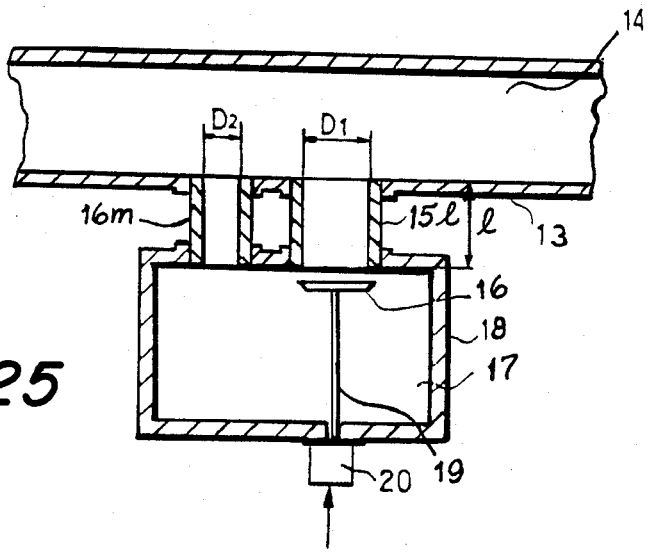
FIG. 25

RESONATOR FOR INTERNAL COMBUSTION ENGINES

RELATED APPLICATION

This application is related to our copending application, Sawada et al., U.S. patent application Ser. No. 559,242, filed Dec. 8, 1983, still pending.

BACKGROUND OF THE INVENTION

The present invention relates to a resonator for internal combustion engines and, more specifically, to a resonator having a plurality of resonant frequencies.

The conventional type resonator 100 of FIG. 1 being located in an intake duct 13, consists of a predetermined closed volume or chamber 17 to which is connected a tubular member 15. The resonant frequency Fp of this type resonator is calculated as follows:

$$Fp = c/2\pi \cdot \sqrt{\pi D^2/4V\,(l + 0.8D)}$$

wherein, D is an inside diameter of the tubular member 15, l is a length of the tubular member 15 and V is the volume of the resonant chamber 17. It has been observed that in the conventional type resonator, dimensions of each component cannot be varied freely. Therefore, the resonant frequency is discriminately determined from such dimensions so that a reduction of an intake noise is achieved only at a specific resonant frequency, thus satisfactory reduction of the intake noise over a wide range of engine speeds is impossible to achieve.

SUMMARY OF THE INVENTION

Accordingly, it is an object of the present invention to provide a resonator for improving the noise reduction characteristics of internal combustion engines.

Another object of the present invention is to provide a resonator for increasing engine output over a wide range of engine speeds.

Another object of the present invention is to provide a resonator having a plurality of tubular connecting members for changing the resonant frequencies in an internal combustion engine by changing the tubular connecting members.

A further object of the present invention is to provide a resonator having a plurality of the tubular connecting members whose lengths are different from each other for controlling the resonant frequencies in internal combustion engines by changing the tubular connecting members.

Another object of the invention is to provide a resonator having a plurality of tubular connecting members whose air-passage transverse cross-sectional areas are different from each other for controlling the resonant frequencies in internal combustion engines by changing the tubular connecting members.

Another object of the present invention is to provide a resonator having a plurality of tubular connecting members for changing resonant frequencies by changing the number of the available tubular connecting members.

Yet another object of the present invention is to provide a resonator having a plurality of tubular connecting members and switch member switching open and close of the tubular connecting member for changing resonant frequencies.

A still further object of this invention is to provide means for changing resonant frequencies by delivering to an actuator of the resonator an electric signal delivered from a computer corresponding to engine rotational speeds at that time.

An additional object of this invention is to provide means for changing resonant frequencies by delivering to an actuator of the resonator an electric signal delivered from a computer corresponding to open/close movements of an intake valve of the engine.

The foregoing, other objects and advantages of the present invention will become apparent from the following detailed description made in connection with the accompanying drawings.

BRIEF DESCRIPTION OF THE DRAWINGS

FIG. 1 is a cross-sectional view of the conventional resonator;

FIG. 2 shows a cross-sectional view of a first embodiment of the resonator for internal combustion engines of the present invention;

FIG. 6 is a flow-chart showing the operation of a computer of the resonator illustrated in FIG. 2;

FIGS. 7 and 8 are fragmentary sectional views of the resonator in FIG. 2, showing different positions of the rotary switch valve giving different resonant frequencies;

FIG. 9 shows the results of the resonator of the first embodiment, comparing rotation speed of the engine and noise level;

FIG. 10 shows a cross-sectional view of a different modification of the resonator of the first embodiment;

FIGS. 11 and 12 are prespective views of a tubular connecting member and a rotary switch valve, respectively, of a further modification of the resonator of the first embodiment;

FIGS. 21 to 25 show cross-sectional views of different modifications of the resonator of the second embodiment, respectively.

DETAILED DESCRIPTION OF THE PREFERRED EMBODIMENT

Figure 3:
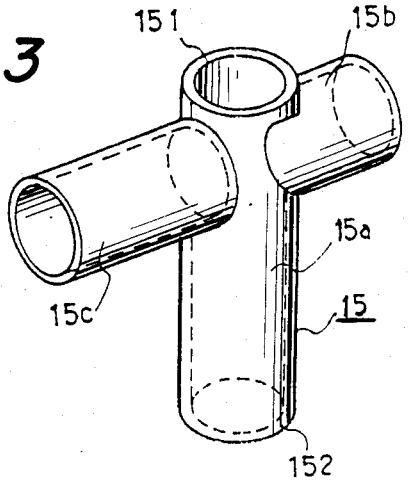
FIGS. 3, 4 and 5 are prespective views respectively of a tubular member, a rotary switch valve and a cap, referenced in FIG. 2.

A first preferred embodiment of a resonator of the present invention, for internal combustion engines, is described with reference to FIG. 2.

In FIG. 2, numeral 1 designates a cylinder in which a piston 2 can move smoothly, and the top of which is covered by a cylinder-head 3, and in the cylinder-head 3, an intake inlet 6 and an exhaust outlet 7 are formed, which are opened and shut periodically by an intake valve 4 and an exhaust valve 5, respectively.

The exhaust outlet 7 is connected by way of exhaust passage 8 to an exhaust pipe wherein a muffler (not shown) is employed for the purpose of suppressing exhaust gas noise.

On the other hand, the intake inlet 6 is connected through an intake passage 9 and a carburetor 10 (not necessary to diesel engines), to an air-cleaner 11 which purifies the intake air. In the upstream end of the air-cleaner 11 is an intake tube 12 to one end of which connects an intake duct 13 the interior 13*a* of which opens into the air.

Figure 4:
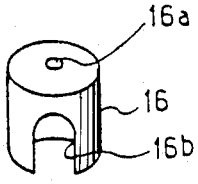
Figure 5:
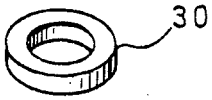

A resonator 100 is provided with a resonant housing 18 making a resonant chamber 17 therein and a tubular connecting member 15 connects the resonant chamber 17 to an air path through intake duct 13. The tubular connecting member 15 is made of polypropylene (PP) and has two tubular branches 15*b*, 15*c* extending horizontally from an outersurface near one end 151 of a tubular stem 15*a*, as shown in FIG. 3. A cup-shaped rotary switch valve 16, shown in FIG. 4, is inserted in the tubular stem 15*a* in an air-tight manner. The bottom 16*c* of the rotary switch valve 16 closes the opening of the one end 151 of the tubular stem 15*a*. In the side wall 16*d* is a port 16*b* which has an air passage area large enough to direct air from the tubular stem 15*a* to either the tubular branch 15*b* or 15*c*. Therefore, one of the two tubular branch 15*b*, 15*c* connects the tubular stem 15*a* when the port 16*b* faces that tubular branch. Connecting bar 19 of an actuator 20 is fixed in a hole 16*a* of the bottom 16*c* of the rotary switch valve 16 by screw. Therefore, the rotary switch valve 16 is rotated by the actuator 20 through the connecting bar 19. A cap 30, shown in FIG. 5, is fixed at the opening of the one end 151 of the tubular stem 15*a* by an adhesive agent for protecting the rotary switch valve 16 from dropping out of the tubular stem 15*a*.

The resonant housing 18 made of polypropylene is cylindrical in shape and the upper end thereof is closed by an end plate 18*a*. Opening 18*b* in the center of plate 18*a* has the same diameter as the outer diameter of the tubular stem 15*a*. The tubular connecting member 15 is fixed at the end plate 18*a* in such a situation that the one end 151 of the tubular stem 15*a* and the two tubular branches 15*b*, 15*c* are contained in the resonant chamber 17. The other end 152 of the tubular stem 15*a* extending from the resonant housing 18 connects with the intake duct 13 for connecting the air path 14 and the resonant chamber 17.

A step-motor, for example, is used as an actuator 20 in order to provide both electrically and easily precise placement control for the rotary switch valve 16. A control computer 21, using a rotation signal delivered from a rotation detecting device (not illustrated) for internal combustion engines, calculates resonant frequencies in synchronism with the engine speeds, and such an electrical signal corresponding to such calculation is applied to the actuator 20. Accordingly, the rotary switch valve 16 fixed on the connecting bar 19 of the actuator 20 rotates clockwise and counterclockwise, along the inside wall of the tubular stem 15*a*, an amount corresponding to the electrical signal from the computer 21.

FIG .6 illustrates the flow-chart of the computer 21. According to this FIG. 6, the rotational signal derived from a distributor or a crank pulley, for example, is applied to the control computer 21 which includes a microcomputer, the engine speed is read out, and the predominant frequency component of the intake noises at each engine speed is calculated. In order to absorb the intake noises corresponding to such frequency components, a driving signal is applied to the actuator 20 which will rotate the rotary switch valve 16 for connecting the tubular stem 15*a* and one of the two tubular branches 15*b*, 15*c*, the resonant frequency will change.

These operations are described as follows:

The lower resonant frequencies $f=F_{low}$ of the resonator when the port 16*b* faces toward the longer tubular branch (as shown in FIG. 7) is calculated as follows:

$$F_{low} = C/2\pi \sqrt{S/(V \times l)}$$

$$l = l_o + l_1$$

wherein, the $l_o$ is the distance from a cross point 0 of the longitudinal axis of the tubular stem 15*a* and the longitudinal axis of the tubular branches 15*b* and 15*c* to the opening end 152 of the tubular stem 15*a*, $l_1$ is the distance from the cross point 0 to the opening end of the longer tubular branch 15*c* and the letter D is the diameter of both tubular members 15*a* and 15*c*.

When the engine rotation speed increases and exceeds the predetermined rotation, the control computer 21 applies a driving signal to the actuator 20 in order to rotate the rotary switch valve 16 until the port 16*b* faces the shorter tubular branch 15*b*. Accordingly, the upper resonant frequencies $f=F_{up}$ when the tubular stem 15*a* is connected with the shorter tubular branch 15*b* (shown in FIG. 8) is calculated as follows:

$$F_{up} = (C/2\pi) \sqrt{S(V \cdot l)}$$

$$(l = l_o + l_2)$$

wherein $l_2(<l_1)$ is a distance from the cross point 0 to the opening end of the shorter tubular branch 15*b*. Since the distance $l_2$ is shorter than the distance $l_1$, the resonant frequencies $F_{up}$ are higher than the resonant frequencies $F_{low}$.

A concrete example of this embodiment is described as follows: The volume of the resonant chamber 17 V=700 cc, the inside diameter of the tubular member 15 D=20 mm, $l_1$=5 mm, $L_2$=32 mm and $l_o$=30 mm. Therefore, the lower resonant frequencies $F_{low}$ is calculated as 130 Hz and the upper resonant frequencies $F_{up}$ is 160 Hz. Accordingly, the resonant frequencies f of the resonator of this embodiment is switched between 130 Hz and 160 Hz by rotating the rotary switch valve 16.

Those parameters, e.g. V, P, $l_1$, $l_2$, and $l_o$, are chosen in order to make a pair of resonant frequencies which coincide with the predominant frequency component of the intake noises.

FIG. 9 shows the intake noise reduction effects in a case where the above-described resonator 100 is provided in an internal combustion engine. In the drawing, the uppermost line illustrates the noise level without resonator 100, and it is clear in the figure that there is a problem of a noise-peak between 4000 r.p.m. and 4800 r.p.m. This noise-peak is subject to the second component of the engine rotation, that is, 133 Hz to 160 Hz. The resonant frequency thus can be varied in synchronism with engine speeds between 4230–4800 r.p.m. in its range of 145 Hz and 155 Hz corresponding to the switching of the rotary switch valve 16 as described above, and this will greatly improve the noise level as shown by the lowermost line relative to that of the engine being provided with the conventional type resonator as shown by the central dot-dash line in FIG. 9.

Though, in the embodiment described above, the actuator 20 is disposed in the resonant housing 18, one could also achieve these results by placing the actuator 20 on the opposite side of the intake duct 13 from the resonant means. Furthermore, in installing such, one could utilize an attachment 131, shown in FIG. 10, for fixing the actuator 20 part from the intake duct 13 so that the actuator 20 can be located where desired in the intake duct 13.

In order to reduce the intake noise more efficiently, it is preferable to make may resonant frequencies coinciding with various frequency components of the intake noise. The tubular member 15 shown in FIG. 11 has four tubular branches 15*b*, 15*c*, 15*d* and 15*e* and the rotary switch valve 16 shown in FIG. 12 has two ports 16*b* and 16*e*. Accordingly, the FIG. 11–12 resonator is able to have four resonant frequencies.

Figure 13:
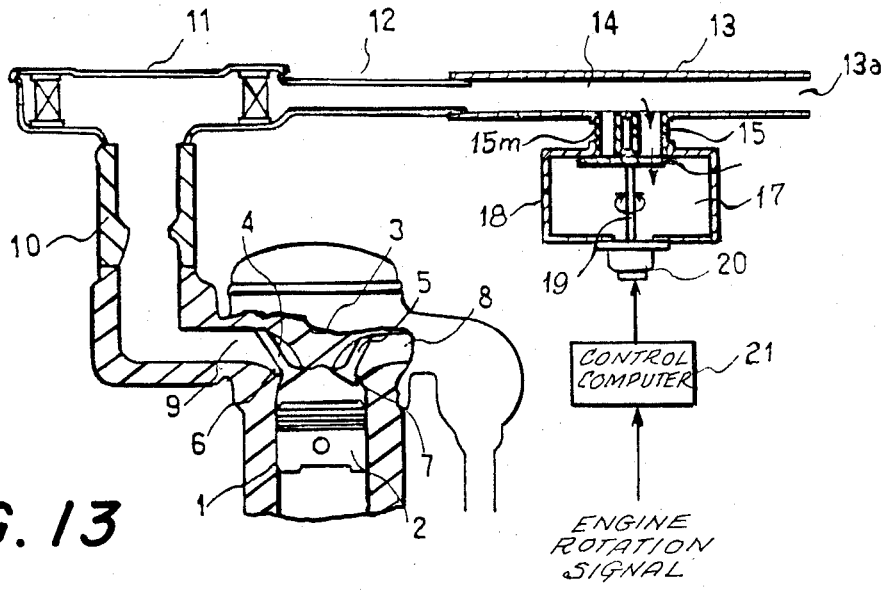
FIG. 13 shows a cross-sectional view of a second embodiment of the resonator of this invention.

FIG. 13 shows a second preferred embodiment of the present invention which has one significant difference from the first embodiment previously described. Though a plurality of tubular members 15 of the first embodiment are different in length from each other, the tubular members 15 of the second embodiment all have the same length. A plurality of tubular members 15 of this second embodiment, however, have different air-passage transverse cross sectional areas.

A first tubular member 151 and a second tubular member 15*m* whose air-passage area is smaller than that of the first tubular member 151 are located between the intake tube 12 or the intake duct 13 and the resonant chamber 18 for connecting therebetween. A rotary switch valve 16 is located at the open end of the first and second tubular members 151 and 15*m* in order to close at least one of the two tubular members 151 and 15*m*. The intake duct 13, the tubular members 151 and 15*m*, the rotary switch valve 16 and the resonant housing 18 are made of resin and those elements 13, 15, 16 and 18 are fixed one to another by adhesive, screws, calking or melting.

Figure 14:
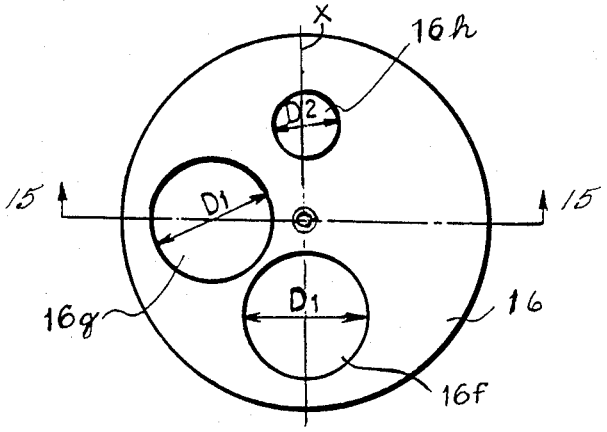
FIG. 14 is a front view of a switch valve illustrated in FIG. 13.
Figure 15:
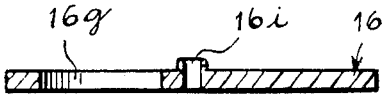
FIG. 15 is a cross-sectional view of the switch valve taken along the line XV—XV of FIG. 14.

As shown in FIGS. 14 and 15, rotary switch valve 16 has first, second and third ports 16*f*, 16*g* and 16*h* which connect the first and the second tubular member 151 and 15*m* and the resonant chamber 17 respectively. A central port 10*i* is also in the center of the rotary switch valve 16 for fixing the connecting bar 19 of the actuator 20. The first and third ports 16*f* and 16*h* are located on the same diameter X and the second port 10*g* is located on the perpendicular diameter Y. The distance from the central port 16*i* to the center of these ports 16*f*, 16*g* and 16*h* is the same and the distance between the first and the third ports 16*f* and 16*h* is same distance as between the first and second tubular member 151 and 15*m*. The inner diameter of the first port D1 is the same as that of the second port D1 and is also the same as that of the first tubular member 151. The inner diameter D2 of the third port 16*h* is smaller than diameter D1 but is the same as that of the second tubular member 15*m*. The diameter of the rotary switch valve 16 is, of course, smaller than the inner diameter of the resonant housing 18 for avoiding contact between the outer periphery of the rotary switch valve 16 and inner wall of the resonant housing 18.

The actuator 20 is electrically controlled by an amount corresponding to the electric signal from computer 21. Namely, computer 21 controls the actuator 20 to rotate clockwise or counterclockwise in order to change the resonant frequencies. The flow chart of the computer is very similar to that of the first embodiment shown in FIG. 6.

Figure 16:
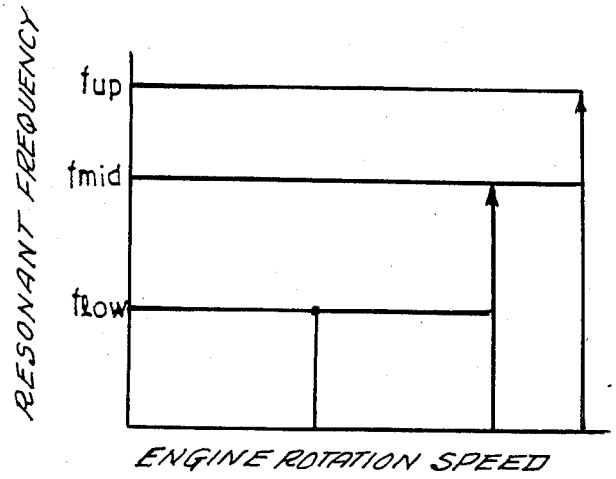
FIG. 16 shows a controlling pattern with respect to engine rotation speed and resonant frequencies of the resonator illustrated in FIG. 13.

The resonator of this second embodiment, however, has three resonant frequencies $F_{low}$, $F_{mid}$ and $F_{up}$ and these three frequencies are selected in relation with the engine rotation speed, as shown in FIG. 16.

Figure 17:
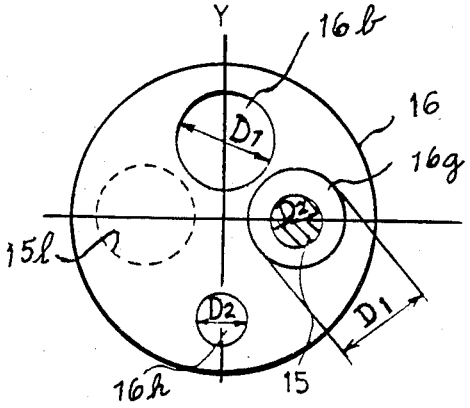
FIGS. 17, 18 and 19 are front views of the switch valve illustrated in FIG. 13, showing different positions for giving different resonant frequencies.

The lower resonant frequency $F_{low}$ is obtained when only the second tubular member 15*m*, whose air-passage area is smaller than that of the first tubular member 151, is connected with the resonant chamber 17 as shown in FIG. 17. The lower resonant frequency $F_{low}$ is calculated by the equation described below:

$$F_{low} = (C/2\pi) \cdot \sqrt{\pi D_2^2/4\,(V \cdot lp)}$$

$$lp = l + 0.8\,D_2$$

Figure 18:
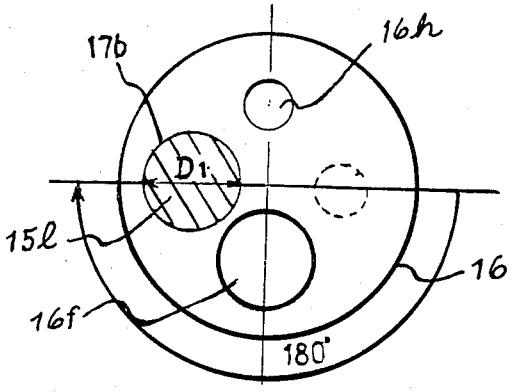

The middle resonant frequency $F_{mid}$ is obtained when only the first tubular member 151 is connected with the resonant chamber 17 as shown in FIG 18. This frequency $F_{mid}$ is calculated by the below equation:

$$F_{mid} = (C/2\pi) \cdot \sqrt{\pi D_1^2/4\,(V \cdot lp)}$$

$$lp = l + 0.8\,D1$$

Figure 19:
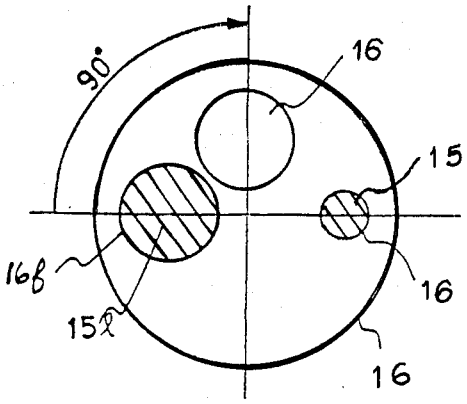

The upper resonant frequency $F_{up}$ is obtained when both tubular members 151 and 15*m* are connected with the resonant chamber 17 as shown in FIG. 19. This frequency $F_{up}$ is calculated by the equation shown below:

$$F_{up} = (C/2\pi) \cdot \sqrt{(\pi D_1^2 + \pi D_2^2)/4\,(V \cdot lp)}$$

$$lp = l + 0.8\sqrt{(D_1^2 + D_2^2)/4}$$

The concrete example of these frequencies of this second embodiment, for example, the volume of the resonant chamber 17 V=1400 cc, the length of both tubular member l=20 mm, D1=20 mm and D2=12, are calculated as follows:

$F_{low}$=89 Hz $F_{mid}$=135 Hz $F_{up}$152 Hz

Figure 20:
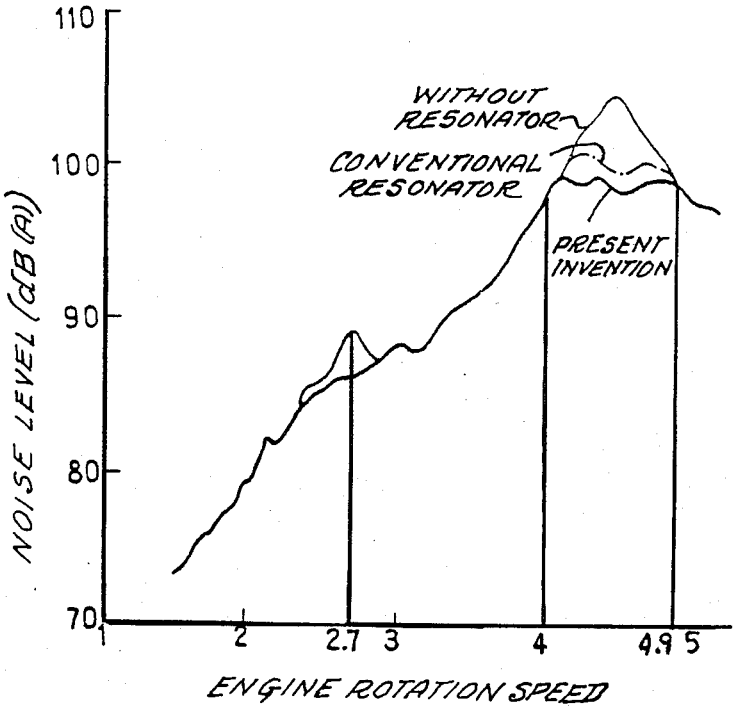
FIG. 20 shows the results using the resonator of the second embodiment, comparing rotation speed and noise level.

Accordingly, the resonator of this second embodiment can change its resonant frequency three ways e.g. 89 Hz, 135 Hz and 152 Hz. FIG. 20 shows the intake noise reduction effects of the resonator of this second embodiment. In the drawing, the uppermost thin line which designates the noise level without the resonator shows two intake noise peaks. One of them appears at about 2700 r.p.m. and another terrible one appears between 4000 r.p.m. and 4900 r.p.m. These noise-peaks are subject to the second component of the engine rotation, i.e. 90 Hz and 133 Hz to 160 Hz. Therefore, the resonator of this second embodiment sets its resonant frequencies as 89 Hz, 135 Hz and 152 Hz and changes these resonant frequencies according to the engine rotation i.e. 2670 r.p.m., 4050 r.p.m. and 4560 r.p.m. respectively. Accordingly, the resonator of this second embodiment, as shown by the lowermost line, can reduce intake noise much more than the conventional type resonator shown by a dot-dash line.

Figure 21:
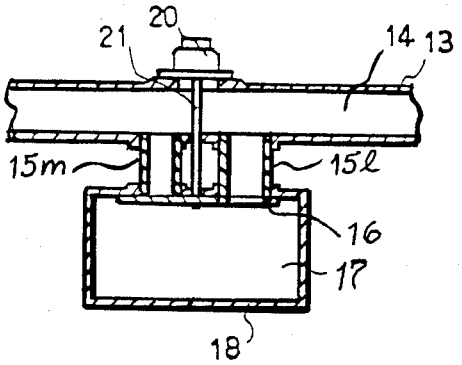
Figure 22:
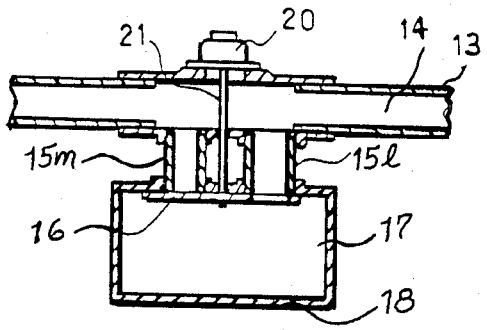
Figure 23:
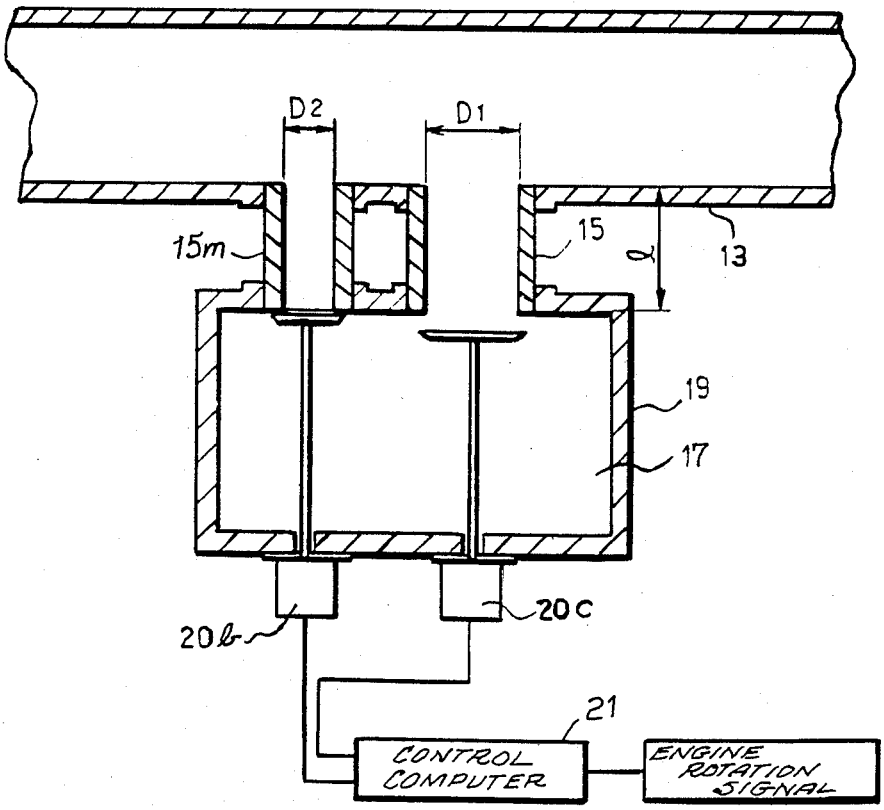

FIGS. 21, 22, 23, 24 and 25 show another species of this embodiment. As shown in FIG. 21, it is also possible to locate the actuator 20 on the intake duct 13 instead of the resonator housing 18. An attachment 131 is used in a modification of this second embodiment as shown in FiG. 22 for fixing the actuator 20 apart from the intake duct 13. The other modification shown in FIG. 23 has two actuators 20*a* and 20*b* which open and close the opening end of the first and second tubular members 151 and 15*m* respectively. Actuators 20*a* and 20*b* may be controlled by only respective ON-OFF electrical signals. Therefore, a small computer can be used for this resonator.

The resonator of this embodiment can change its resonant frequencies by only one ON-OFF controlled actuator 20 as shown in FIGS. 24 and 25.

In addition, the resonators in the preferred embodiments may be practiced otherwise, than as described herein, as follows; it is a well known fact that if a resonant frequency subject to the intake air-passage conduit is identical to the open/close cycles of the intake valve, a large quantity of mixed gases (fuel and intake air) is introduced into the cylinder. Therefore, in light of the conventional teachings, appropriate lengths of the intake conduit are selected in order to get a desired resonant frequency for certain engine rotation speeds of the internal combustion engines, and as a result, the engine output of such engine speeds will thus be increased.

Therefore, if the identical resonant frequency of the intake conduit is varied by changing the resonant frequency of the resonator as aforementioned, and further if it is in synchronism with the open and close timing of the intake valve 4, the resonator of this invention will work as means to increase the ouput over the whole range of the engine speeds.

Obviously many other modifications and variations of the present invention are possible in light of these teachings than the preferred embodiments specifically described herein.

Namely, in the above-mentioned preferred embodiments, the actuator is used in the intake line as means for reducing the intake noise, and if the same resonator is disposed in the exhaust line, the resonator will operate as a means for reducing the exhaust noise.

As described above, the resonator of the present invention is designed to vary the opening sectional area and/or the lengths of the tubular member of the resonator by the actuator in synchronism with the engine speeds, and the resonator of this invention can control the resonant frequency of the intake line, thus assuring a wider frequency range of the resonant effectiveness than that of conventional resonators.

What is claimed is:

1. A resonator for an internal combustion engine having intake and exhaust pipes connected with a cylinder of said internal combustion engine, said resonator comprising:

resonator means defining a predetermined closed volume for absorbing resonant noises generated in said engine, a tubular connecting member means disposed between said resonator means and one of said pipes for forming a continuous passage from said one pipe to said resonator means, said tubular connecting member means including a tubular stem connecting to said one pipe at an opening thereof and a plurality of tubular branches extending from an outer surface of said tubular stem internally of said resonator means, the lengths of said tubular branches being different from each other, and switch means connected with said tubular connecting member means for changing as between said different length tubular branches in accordance with operational conditions of said engine to absorb said noises from said engine.

2. A resonator according to claim 1, wherein said switch means includes a valve disposed in said tubular stem, an actuator for moving said valve in a sense to change between which of said tubular branches provides said continuous passage with said tubular stem upon reception of an electric signal and computer means operable in response to said engine rotation speed to emit said electric signal for controlling said actuator.

3. A resonator according to claim 2 wherein said valve is a rotary valve which is cylindrical and has a port on the peripheral surface thereof and said tubular stem is alternatively connected with respective ones of said tubular branches when said port faces to respective ones of said tubular branches.

4. A resonator according to claim 2, wherein said actuator is a motor which rotates said valve.

5. A resonator for an internal combustion engine having intake and exhaust pipes connected with a cylinder of said internal combustion engine, said resonator comprising:

resonator means defining a predetermined closed volume for absorbing resonate noises generated in said engine, a plurality of tubular connecting members disposed between said resonator means and at least the intake pipe of one of said pipes for forming a plurality of selectably open continuous passages from said one pipe to said resonator means, and swtich means connected with said tubular connecting members for changing which of said continuous passages is open, in accordance with operational conditions of said engine to absorb said noises from said engine.

6. A resonator as defined in claim 5, wherein said tubular connecting members all connect at a respective one end of each said member to said one pipe and all connect to said resonator means at another respective end of each such member, each for providing a respective said passage leading from said one pipe to said resonator means, and said switch means includes a valve means constructed and arranged for respectively opening and closing selected ones of said tubular connecting members, an actuator for moving said valve means upon receipt of an electric signal and computer means operable in response to engine rotational speed to emit said electric signal for controlling said actuator.

7. A resonator according to claim 6 wherein:

each said tubular connecting member has an air passage of different effective transverse cross-sectional area than that of the others of said tubular connecting members.

8. A resonator according to claim 6, wherein said valve means is disposed at an opening end of each said tubular connecting member, an actuator for moving said valve means upon reception of an electric signal and computer means operable in response to said engine rotation speed to emit said electric signal for controlling said actuator.

9. A resonator according to claim 8, wherein said valve means comprising a plurality of valves, each being disposed at said opening end of a respective said tubular connecting member and said actuator selectively moves each said valve in the axial direction in the respective said tubular connecting member, each said tubular connecting member being connected with said resonator means when the respective said valve is detached from said opening end of the respective said tubular connecting member and that said tubular connecting member being disconnecting from said resonator means when the respective said valve is attached with said opening end of that said tubular connecting member.

10. A resonator according to claim 8, wherein said valve means is plate shaped and has a port, each said tubular connecting member being connected with said resonator means when said port faces said opening end of that said tubular connecting member.

11. A resonator according to claim 10, wherein said actuator is a motor being connected with said valve means and rotating said valve means upon reception of said electric signal.

12. A resonator according to claim 8, wherein said valve means is plate shaped and has a plurality of ports whose air-passage areas are different from each other, each said tubular connecting member is connected with said resonator means when said port faces to that said opening end of said tubular connecting member.

13. A resonator according to claim 12, wherein said actuator is a motor being connected with said valve means and rotating said valve means upon reception of said electric signal.

* * * * *